US006795766B2

(12) United States Patent
Theisen et al.

(10) Patent No.: US 6,795,766 B2
(45) Date of Patent: Sep. 21, 2004

(54) CIRCUIT CONFIGURATION FOR THE STARTER OF AN AUTOMOTIVE INTERNAL COMBUSTION ENGINE

(75) Inventors: Johannes Theisen, Ludwigsburg (DE); Martin Gruenewald, Brackenheim (DE)

(73) Assignee: Robert Bosch GmbH, Stuttgart (DE)

( * ) Notice: Subject to any disclaimer, the term of this patent is extended or adjusted under 35 U.S.C. 154(b) by 224 days.

(21) Appl. No.: 09/937,894

(22) PCT Filed: Jan. 17, 2001

(86) PCT No.: PCT/DE01/00173

§ 371 (c)(1),
(2), (4) Date: Oct. 2, 2001

(87) PCT Pub. No.: WO01/59294

PCT Pub. Date: Aug. 16, 2001

(65) Prior Publication Data

US 2002/0183918 A1 Dec. 5, 2002

(30) Foreign Application Priority Data

Feb. 10, 2000 (DE) ..... 100 05 778

(51) Int. Cl.[7] ..... G06G 7/70
(52) U.S. Cl. ..... 701/113; 123/179.3; 701/114
(58) Field of Search ..... 123/179.1, 179.14, 123/179.25, 179.3; 701/104, 103, 105, 113, 114, 115

(56) References Cited

U.S. PATENT DOCUMENTS 4,005,342 A * 1/1977 Davis ..... 361/56
4,331,109 A * 5/1982 Arnault ..... 123/179.21
4,862,010 A 8/1989 Yamamoto ..... 290/38 R
4,888,697 A * 12/1989 Hemminger et al. ..... 701/114
4,924,399 A * 5/1990 Kaiser et al. ..... 701/101
6,389,353 B2 * 5/2002 Kondo ..... 701/114
6,415,210 B2 * 7/2002 Hozuka et al. ..... 701/29
6,438,487 B1 * 8/2002 Mingo et al. ..... 701/113

FOREIGN PATENT DOCUMENTS

DE 198 11 176 A 4/1999

* cited by examiner

*Primary Examiner*—Willis R. Wolfe
*Assistant Examiner*—Johnny H. Hoang
(74) *Attorney, Agent, or Firm*—Michael J. Striker

(57) ABSTRACT

According to the invention, a circuit arrangement for a starter of a motor vehicle internal combustion engine is proposed, with which the starting relay (4) remains activated during a time-limited voltage dip (undervoltage of the battery). Between a computer (19) and an end stage (3) for triggering the starting relay (4), a memory circuit (2) is connected to a locking circuit (1), which in the event of undervoltage of the battery (20) maintains the status at a control input STEN during the voltage dip. A computer (19) which has entered a reset mode during the voltage dip is reactivated after the termination of the voltage dip and controls the locking circuit (1) in such a way that the starting relay (4) now continues to be triggered via the control input STEN. To obtain a defined outset state of the flip-flop (14, 15) upon reconnection of the battery, an RC member is disposed in the memory circuit.

8 Claims, 1 Drawing Sheet

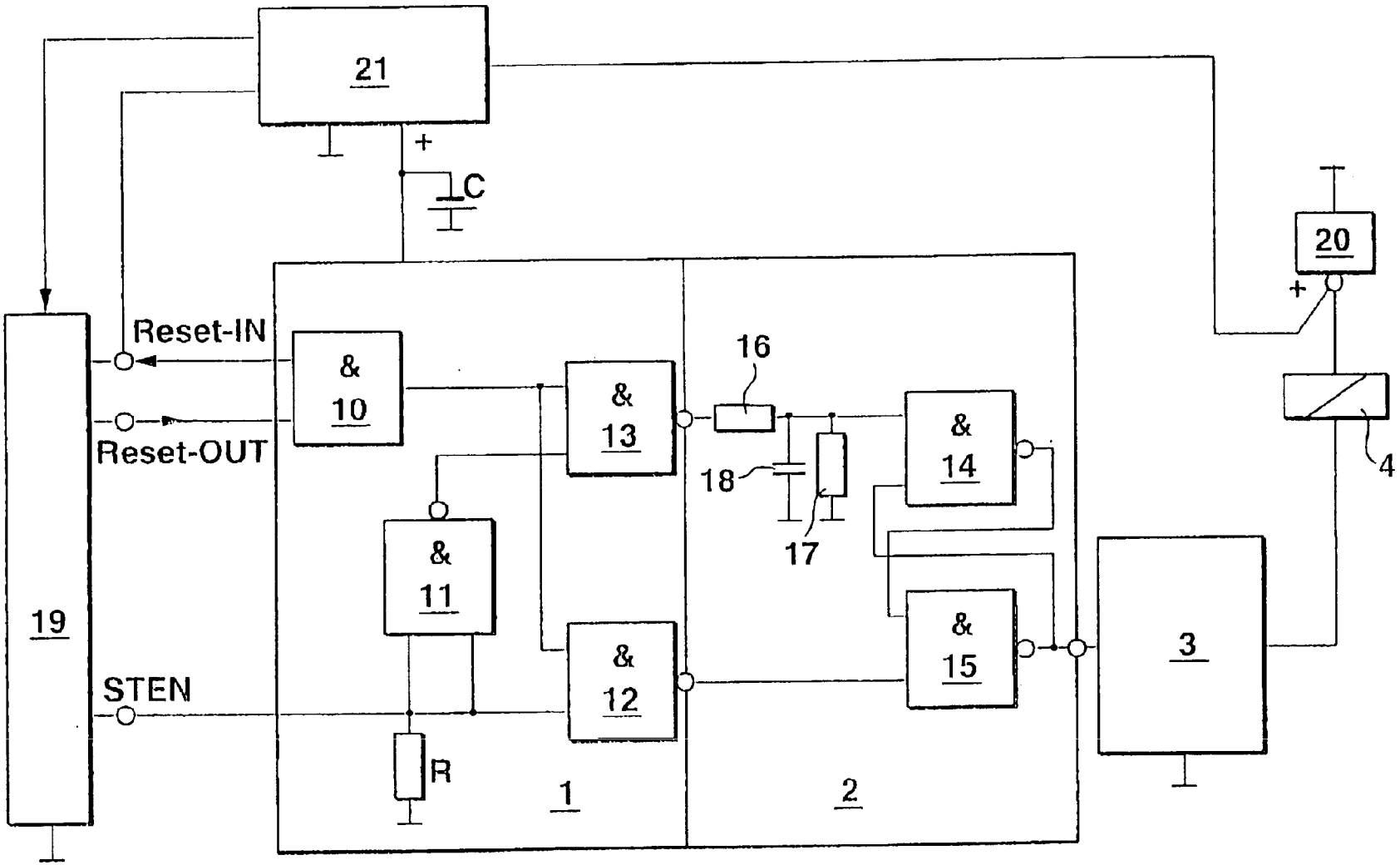
20
4
3
&
14
&
15
2
17
16
18
&
13
&
12
1
&
11
R
C
21
&
10
Reset-IN
Reset-OUT
STEN
19

CIRCUIT CONFIGURATION FOR THE STARTER OF AN AUTOMOTIVE INTERNAL COMBUSTION ENGINE

BACKGROUND OF THE INVENTION

The invention is based on a circuit arrangement for controlling a starting relay of a starter for a motor vehicle internal combustion engine as generically defined by the preamble to the main claim. From German Patent Disclosure DE 198 11 176 A1, an arrangement and a method are already known in which a computer (controller) controls the starter current for starting the starter after the closure of the contacts of a starting relay (two-stage process). The computer controls the voltage and/or current, or the ON time for the starter until such time as the engine has turned over. However, if some malfunction of the computer occurs, which can happen especially with an old, weak battery, and at low temperatures, for instance, then this necessarily causes the failure of the starting relay and thus the undesired interruption of the starting event. The engine can no longer turn over in that case.

SUMMARY OF THE INVENTION

The circuit arrangement of the invention for controlling the starting relay has the advantage over the prior art that the starting event for the engine can be continued even if a chronologically limited voltage drop occurs at the starting relay. This has the advantage that even with a weak battery, as long as there is still enough energy to crank the engine, the engine can in fact turn over. This means that a trip to a repair facility can at least be postponed.

It is especially advantageous that upon the occurrence of a voltage dip, the memory circuit with the flip-flop freezes the instantaneous logic switching state of the starting relay. This is because a voltage dip can means that the controlling computer can no longer be supplied with sufficient energy. In that case, the computer switches to the reset mode, to prevent mistaken control actions. Only once the undervoltage has been eliminated and the computer has regained full control after the voltage dip, does the computer switch the locking circuit to inactive status again and can now resume the normal control mode for operating the starting relay.

The locking circuit is advantageously embodied such that it functions perfectly even at such low voltages that the controlling computer can no longer be operated. In this way, voltage dips down to approximately 4 volts, for instance, can be spanned without chronological limitation. By buffering the supply voltage, for instance using electrolyte capacitors, brief voltage dips, lasting 100 ms and longer, for instance, even down to 0 volts, can be spanned; the duration is determined by the corresponding dimensioning.

BRIEF DESCRIPTION OF THE DRAWINGS

One exemplary embodiment of the invention is shown in the drawing and described in further detail in the ensuing description. The drawing is a block circuit diagram of one exemplary embodiment of the invention.

DETAILED DESCRIPTION OF THE PREFERRED EMBODIMENTS

The drawing shows a computer 19, which is connected via an output STEN to a control input of a locking circuit 1. The computer 19 is also connected to the locking circuit 1 via a reset-IN input and a further output, reset-OUT.

For the sake of clarity, only the circuit blocks that individually reflect the essential functions are shown here.

It is also pointed out that to maintain the function of the locking circuit during the voltage dip, a voltage preparation means 21 is provided, which is connected on the input side directly to the battery 20. Its control input is connected to the reset-IN terminal, by way of which it obtains a corresponding signal in the event of undervoltage. In that case, via its output line, which is buffered with an electrolyte capacitor C, it maintains the standby supply for the locking circuit 1 and as needed for the computer 19.

The locking circuit 1 has a first NAND gate 12 and a second NAND gate 13. The control input STEN is connected to one input of the first NAND gate 12, while the second input together with a reset line is carried to a first input of the second NAND gate 13. The reset line is supplied from an AND gate 10, both of whose inputs (reset-IN and reset-OUT) are connected to the computer 19. The control input STEN is also connected to both inputs of a third NAND gate 11, operated as an inverter, whose output is carried to the second input of the second NAND gate 13. For initialization, the control input STEN is also applied to ground, via a resistor R.

Connected downstream of the locking circuit 1 is a memory circuit 2, which essentially has a flip-flop, comprising the two NAND gates 14 and 15, and the RC circuit having the resistor 17 and the capacitor 18 and a coupling resistor 17. The coupling resistor 16 is connected to the inverting output of the second NAND gate 13 and carries its signal via an input of the NAND gate 14. Both the resistor 17 and the capacitor 18 are connected to ground parallel to this input. The inverting output of the first NAND gate 12 is conversely connected to an input of the NAND gate 15, while the two free inputs of the two NAND gates 14, 15 are connected crosswise to the corresponding outputs. The output of the NAND gate 15 is connected to the control input of an end stage 3 and via its output controls the starting relay 4, which in turn, via contacts not shown, on the one hand closes the main current circuit to the starter and on the other couples the drive pinion into the flywheel of the engine. To that end, the starting relay 4 is connected to the positive pole of a battery 20.

The mode of operation of this arrangement will now be explained in further detail.

In the normal operating mode, when the full battery voltage of the battery 20 is available, the computer 19, via the control input STEN, controls the locking circuit 1 and the memory circuit 2 the end stage 3 in such a way that the starting relay 4 is supplied with current and actuates the engaging magnet of the starter and thus closes the main current circuit for actuating the starter. If the battery voltage collapses, for instance, after the main current circuit for the starter has been switched on, then as a consequence of the undervoltage the computer 19 automatically moves to a reset mode. The undervoltage can persist for a certain length of time, for instance because the battery is too weakly charged or has too little capacity in extremely cold weather. In that case, the interposed logic having the locking circuit 1 and the memory circuit 2 stores the instantaneous state at the control input STEN in memory. This voltage level prevailing at the control input STEN is stored in memory with the flip-flop 14, 15 in such a way that the end stage 3 continues to be triggered via the control input. The starting relay 4 thus maintains its current state. The locking is undone only once the battery voltage is again available and the computer 19 has taken over control of the triggering of the starting relay 4. After its initialization, the computer applies the set-point state to the control input STEN once again. Only after that does the computer 19 take the reset-OUT signal back again, so that the end stage 3 is now triggered directly again via the control input STEN. The input reset-IN is the signal that in the event of undervoltage puts the computer 19 into the reset state. Via this line, the computer 19 accordingly learns that a undervoltage is present, and to protect against malfunctions, it switches itself to the reset mode.

With the reset-OUT signal, the computer reports that it is in the reset state. This signal is actively taken back by the computer on the basis of a corresponding program. It is thus assured that the control input STEN is put into the desired state before the signal is taken back to the reset-OUT output. This advantageously prevents an interruption in the meantime of the triggering for the starting relay 4.

With the RC wiring, it is assured that after a reconnection of the battery or a change of the battery in a repair facility (power failure), the memory circuit puts the relay into an inactive state.

The dimensioning of the circuit is designed such that undervoltages down to 0 volts, for instance, and over a period of time of about 100 ms or longer can be spanned. Under these conditions, predetermined conventional test cycles can be performed successfully. Naturally given dimensioning designed differently, still other voltage dips can also be spanned.

What is claimed is:

1. A circuit arrangement for controlling a starting relay of a starter for a motor vehicle internal combustion engine, comprising, a battery (20), wherein said battery is electrically connected to the starting relay (4);

a computer (19) that is disposed in the control circuit of the starting relay (4), wherein between the computer (19) and the starting relay (4), a memory circuit (2) is disposed, wherein said memory circuit is embodied to maintain the existing control signal (STEN) for the starting relay (4) during a chronologically limited undervoltage of the battery (20), wherein between the comouter (19) and the memory circuit (2), a locking circuit (1) is disposed, and wherein the locking circuit (1) detects the instantaneous logic state at a control input (STEN) and stores it in memory with the aid of the memory circuit (2).

2. The circuit arrangement of claim 1, wherein the memory circuit (2) has a ftip-flop (14, 15).

3. The circuit arrangement of claim 2, wherein the flip-flop (14, 15) is settable by means of an RC circuit (17, 18) in such a way that the starting relay (4) is set to the inactive state upon reapplication of the battery voltage.

4. The circuit arrangement of claim 1, wherein the locking circuit (1) is embodied to maintain the triggering for the starting relay (4) if the computer (19) is in a reset mode.

5. The circuit arrangement of claim 1, wherein the computer (19) switches the locking circuit (1) to be inactive once the undervoltage of the battery (20) is ended.

6. The circuit arrangement of claim 1, wherein the computer (19) has a program with which the locking circuit (1) and/or the memory circuit (2) can be controlled.

7. The circuit arrangement of claim 1, wherein the locking circuit and memory circuit (1, 2) span a voltage dip down to approximately 0 volts.

8. The circuit arrangement claim 7, wherein voltages up to approximately 4 volts can be spanned without chronological limitation, and voltages under 4 volts can be spanned with chronological limitation.

* * * * *